US005676444A

United States Patent [19]

Liao

[11] Patent Number: 5,676,444

[45] Date of Patent: Oct. 14, 1997

[54] NEON LIGHT BOX

[76] Inventor: Chun-Chi Liao, No. 9, Lane 126, Min-Sheng Road, Taichung City, Taiwan

[21] Appl. No.: 571,314

[22] Filed: Dec. 12, 1995

[51] Int. Cl.[6] ..... G09F 13/00

[52] U.S. Cl. ..... 362/31; 362/812; 362/329; 40/546; 40/575; 40/711; 40/716

[58] Field of Search ..... 362/31, 260, 328, 362/329, 330, 812; 40/546, 575, 711, 716, 753

[56] References Cited

U.S. PATENT DOCUMENTS

| | | | |
|---|---|---|---|
| 3,885,336 | 5/1975 | Olsen | 40/711 |
| 5,130,898 | 7/1992 | Akahane | 362/31 |
| 5,174,056 | 12/1992 | King | 40/575 |
| 5,261,174 | 11/1993 | Blegen | 40/711 |
| 5,555,654 | 9/1996 | Hermann | 362/31 |
| 5,558,420 | 9/1996 | Oki et al. | 362/31 |

FOREIGN PATENT DOCUMENTS

| | | | |
|---|---|---|---|
| 636918 | 2/1995 | European Pat. Off. | 40/546 |

*Primary Examiner*—Ira S. Lazarus
*Assistant Examiner*—Sara Sachie Raab
*Attorney, Agent, or Firm*—Pro-Techtor International

[57] ABSTRACT

A neon light box which uses a C.C.F.L. and a light guide to provide a more uniform and brighter light source than in prior art devices. The neon light box has ferro-metallic bars on the window and the top cover, to which a transparent cover with magnetic bars fixed thereon is attached to provide a space for displaying an advertisement slide. The light box uses metal bars mounted to a top cover and window to compensate for the height difference between the top cover and the window, so as to create a smooth surface when used in conjunction with a transparent cover.

6 Claims, 7 Drawing Sheets

NEON LIGHT BOX

FIELD OF THE INVENTION

The present invention relates generally to a neon light box used in commercial advertisement. The box has a very thin body, and it is easy to change the "slide" above the light source. The box is easy to operate and can be repeatedly used.

BACKGROUND OF THE INVENTION

The neon light boxes used in commercial advertising are large and heavy. The conventional neon light box uses a plurality of fluorescent light tubes as the light source, which requires tremendous electricity consumption. Still, the brightness may not be uniform due to poor arrangement of the fluorescent light tubes.

It is also difficult to change the "slide" disposed above the light source without destroying the box. This causes a waste of material and money. The present construction also creates a device that is impractical to use because of the one-way emission of the light of the neon light box.

To solve such problems, it would be advisable to provide a neon light box having a very thin body. The neon light box of the present invention uses a cold cathode fluorescent light or a hot cathode fluorescent light, preferably the cold cathode fluorescent light (C.C.F.L.). The box has a light guide with high efficiency of electricity consumption and provides a uniform light source for the "slide" thereabove.

SUMMARY OF THE INVENTION

It is therefore an object of the present invention to provide a neon light box which uses a C.C.F.L. and a light guide to provide a more uniform and brighter light source.

Another object of the present invention is to provide a neon light box having ferrometallic bars on the window and the top cover, to which a transparent cover with magnetic means fixed thereon is attached to provide a space for displaying an advertisement slide.

Still another object of the present invention is to provide a neon light box using metal bars mounted to a top cover and window to compensate for the height difference between the top cover and the window, so as to create a smooth surface when used in conjunction with a transparent cover.

The present invention as will be disclosed by the accompanying drawings and description is not to limit the scope or spirit of the invention. They are merely described as preferred embodiments of the present invention.

BRIEF DESCRIPTION OF THE DRAWINGS

Reference is now made to the accompanying drawings, in which is shown an illustrative embodiment of the present invention from which its novel features and advantages will be apparent, wherein.

DETAILED DESCRIPTION OF THE PREFERRED EMBODIMENT

Figure 1:
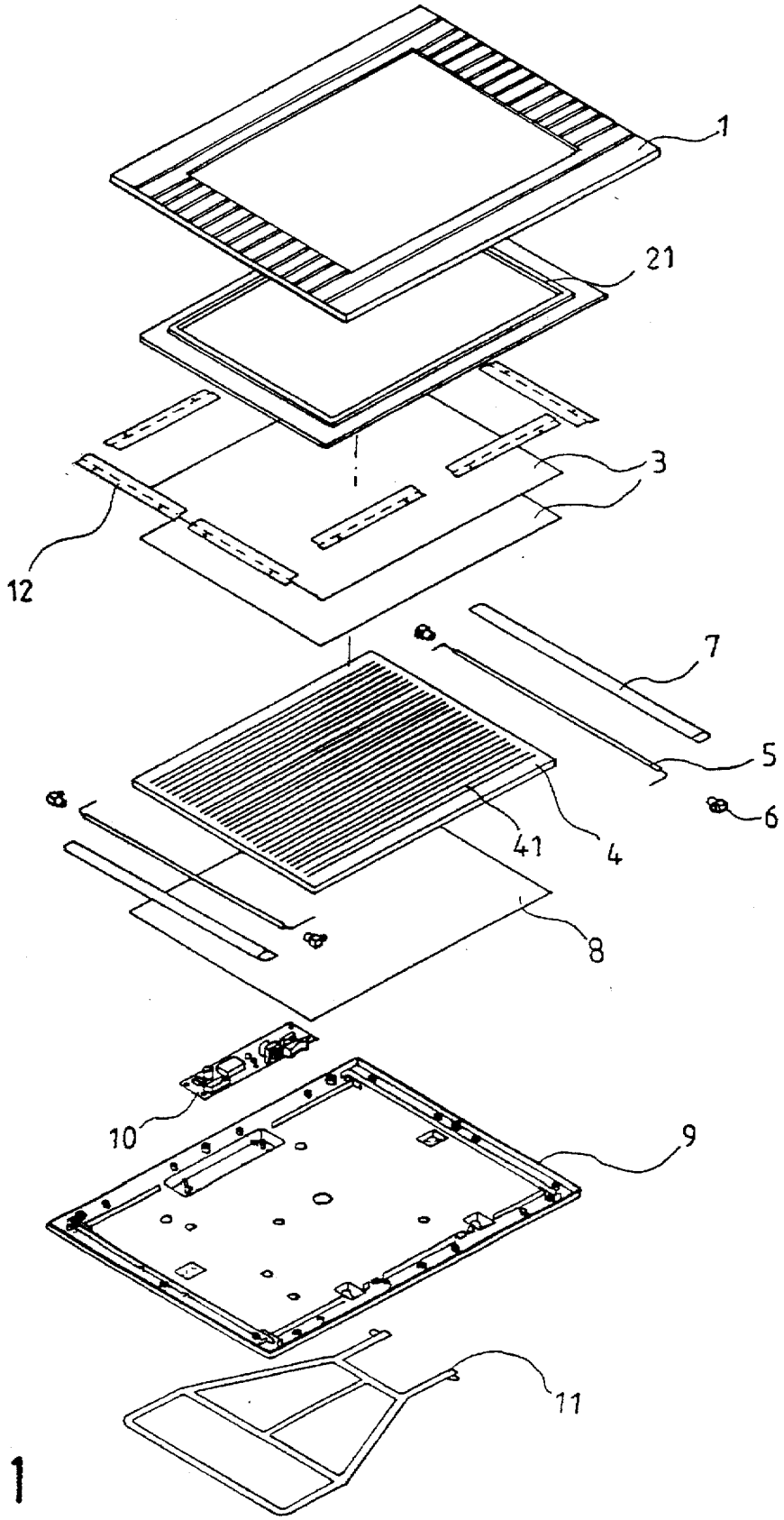
FIG. 1 is an exploded perspective view of a neon light box constructed in accordance with the present invention.

Referring first in particular to FIG. 1, the neon light box of the present invention comprises a top cover 1 that receives in a central opening a window 2 that is secured to the top cover 1. The window 2 includes ferro-metal bars that align with an inner perimeter of the central opening of the top cover 1. The bars 21, create a flat upper surface of the box when uses in conjunction with a transparent cover.

A diffuser 3, located under the window 2, is used in conjunction with a light guide 4 to make the light emitted from the light source uniformly dispersed. A C.C.F.L. (cold cathode fluorescent light) 5 is secured on both sides of the light guide 4 to provide the light required by the neon light box. A rubber cap 6 is secured at both ends of the C.C.F.L. 5 as an insulation and shock absorption agent. An aluminum film 7 secured to the outer edge of the C.C.F.L. 5 concentrates and reflects the light from the C.C.F.L. 5 to the light guide 4.

Figure 2:
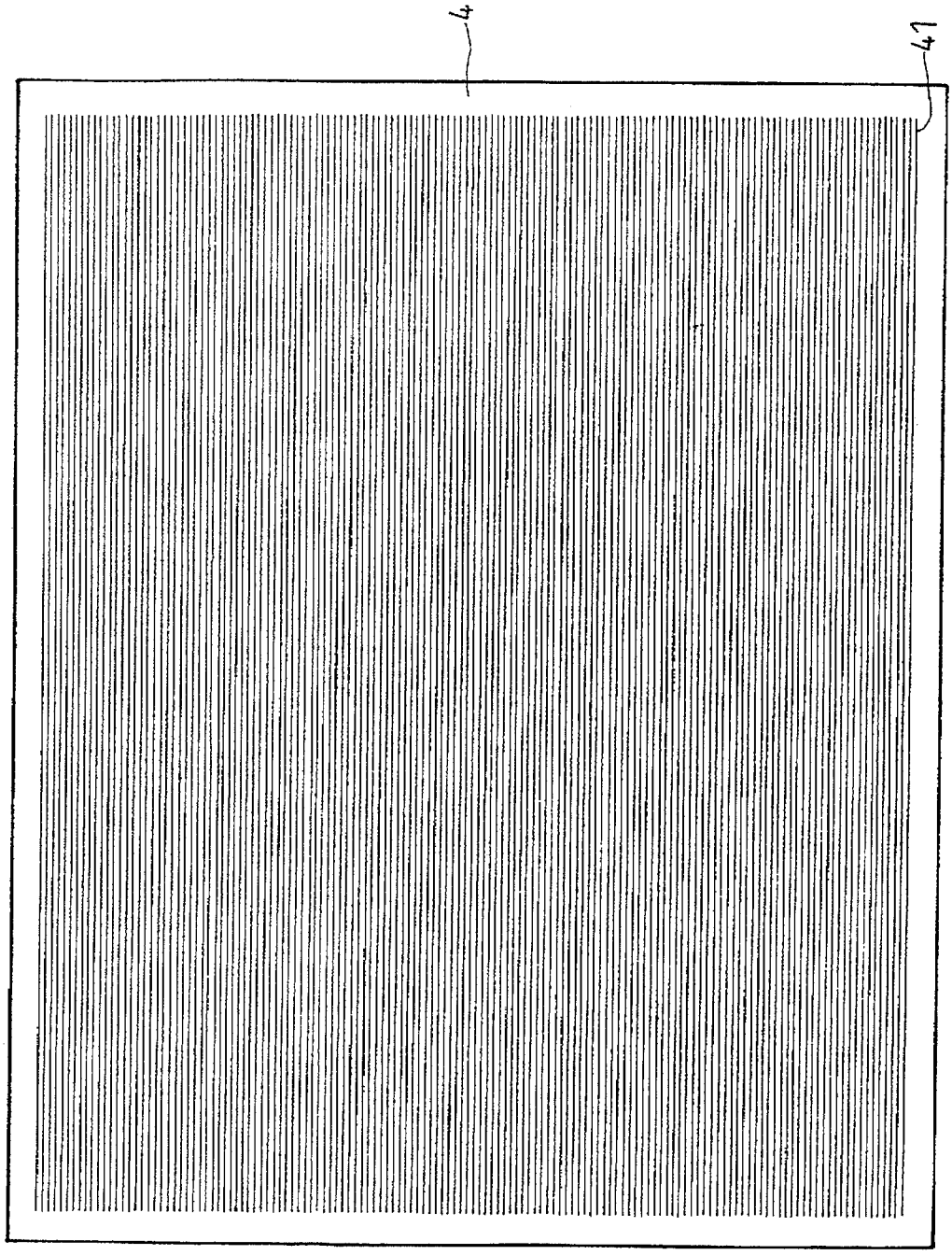
FIG. 2 is a top view of an enlarged light guide used in the present invention.

A plurality of grooves 41 are formed on the surface of the light guider 4 (as shown in FIG. 2). The depth of the grooves 41 gradually increases toward the center of the light guide 4, which allows the light from the C.C.F.L. 5 to emit uniformly via the continuous reflection of the grooves 41. The uniform emission of the light of the C.C.F.L. 5 onto the light guide 4 is much brighter than that of prior light guides having a printed round spot, and is much more effective.

Figure 3:
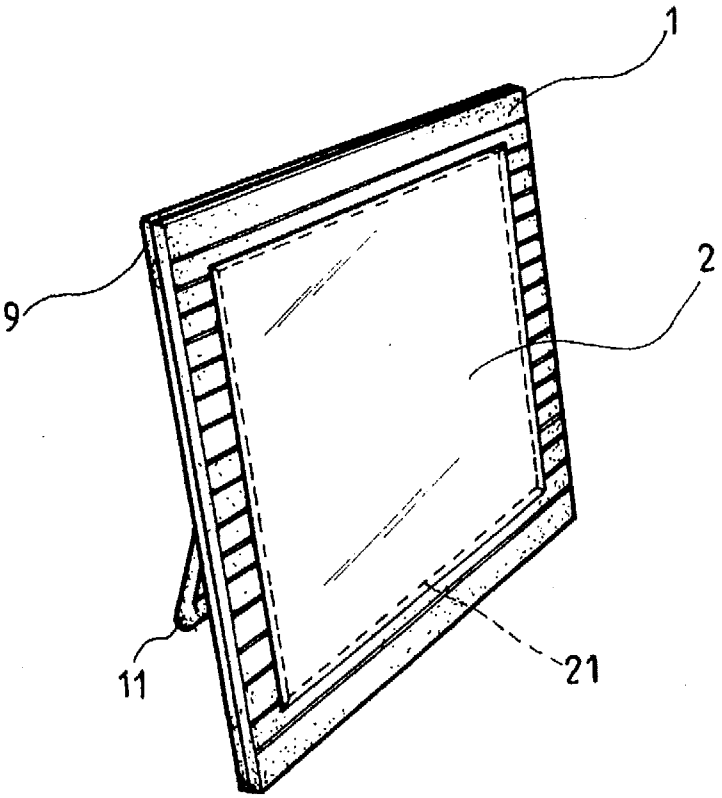
FIG. 3 is a perspective view of the present invention.

A reflection sheet 8 is disposed under the light guide 4 to reflect the light from the light guide 4 toward the window 2. Arranged under the reflection sheet 8 is a bottom cover 9 having a recess for receiving therein a power converter 10. The power converter 10 converts input DC current into AC current needed by the C.C.F.L. 5. A support 11 is pivotally attached to an outer side of the bottom cover 9 for supporting the neon light box of the invention when needed. Under the window 2, with the help of a plurality of securing strips 12, preferably made of metal, the diffuser 3, light guide 4, and the reflection sheet 8 are secured within the bottom cover 9. This assembly is later secured to the top cover 1 to complete the assembly of the neon light box (as shown in FIG. 3).

Figure 4:
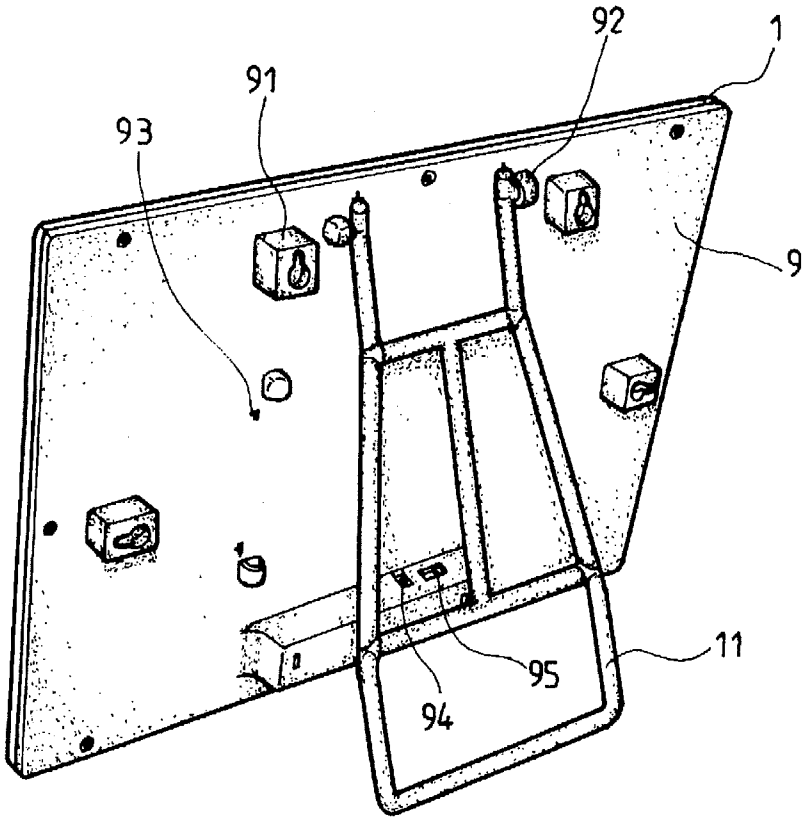
FIG. 4 is another perspective view showing the back of the present invention.
Figure 5:
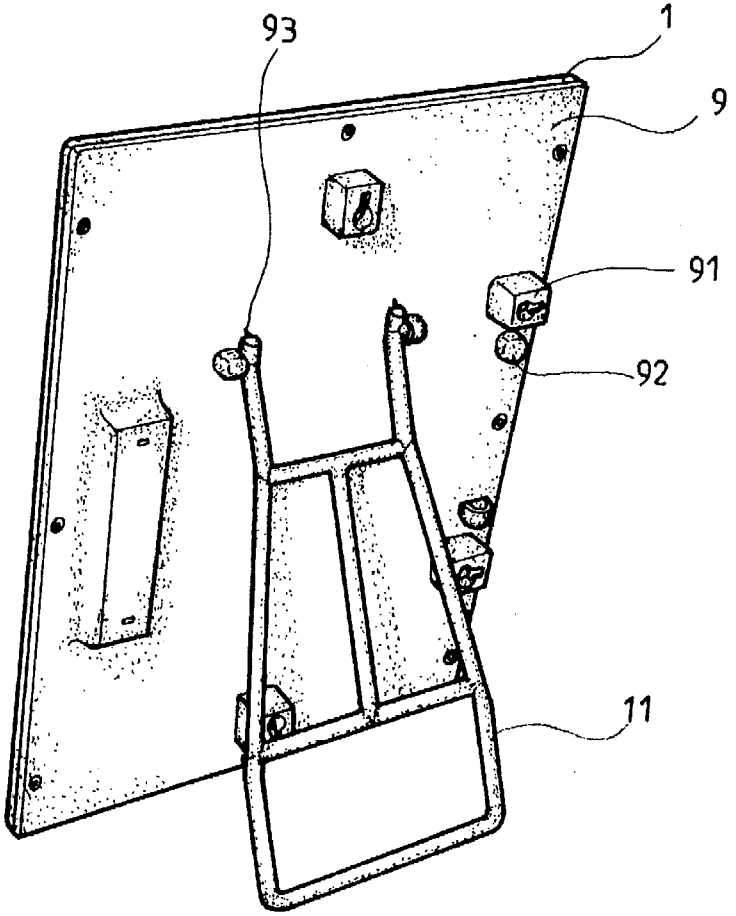
FIG. 5 is another embodiment of the moveable support of the present invention.

Please refer now to FIG. 4, which is a perspective view of the neon light box of the present invention showing the back side of the bottom cover 9. A plurality of hanging means 91, support anchors 92, and protrusions 93 are formed on the back side of the bottom cover 9. The hanging means are to hang the neon light box on a wall. The support anchors 92 and protrusion 93 provide two different positions to pivotally attach a movable support 11 so as to provide a variety of ways of positioning the box. The box may be on its side as shown in FIG. 3, or vertical as shown in FIG. 5. In either case, the support 11 is placed against the protrusion 93 so as to prevent sliding of the support 11. Power socket 94 and power switch 95 are also provided on the bottom cover 9 for external power connection.

Figure 6:
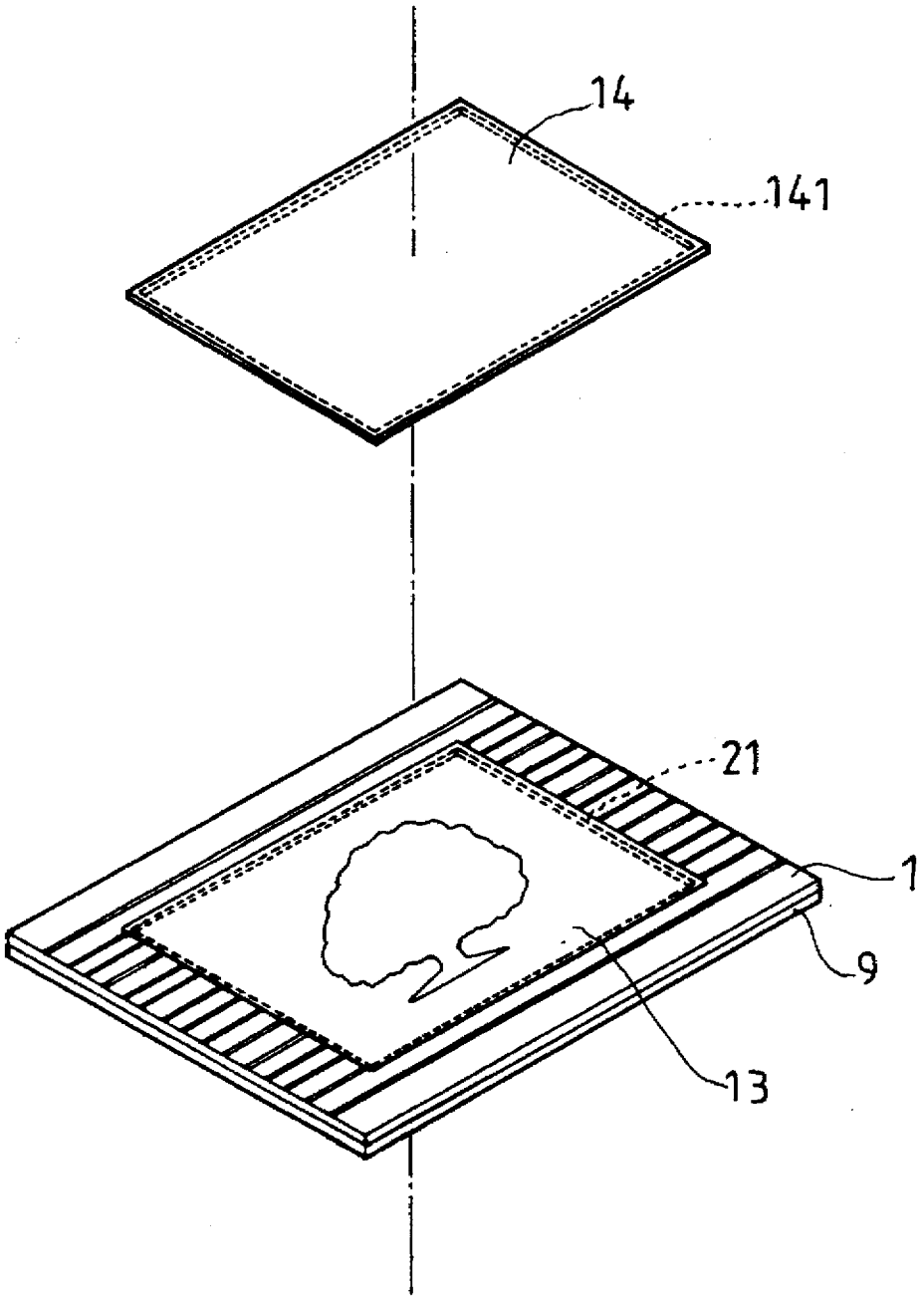
FIG. 6 is a schematic diagram of changing the "slide" of the neon light box of the present invention.

Referring to FIG. 6, if a slide change is frequently required, a transparent cover 14 having magnetic means 141 corresponding to the bars 21 of the window 2 is provided. The space between the transparent cover 14 and the window 2 by means of the magnetic attraction of the magnetic means 1 41 to the bar 21. The space between the window 2 and the diffuser 3 provides a second alternate space for displaying another slide 13.

When changing the slide is required, the transparent cover 14 is first removed and the slide 13 is put on the window 2, and then covered with the transparent cover 14. The transparent cover 14 is firmly secured to the window 2 by means of the magnetic attraction between magnetic means 141 of the transparent cover 14 and the bar 21 of the window 2. Thus, the slide 13 is also secured. The thickness of the transparent cover 14 is selected to be equal to the height difference between the window 2 and the top cover 1 so as to provide a smooth surface.

Figure 7:
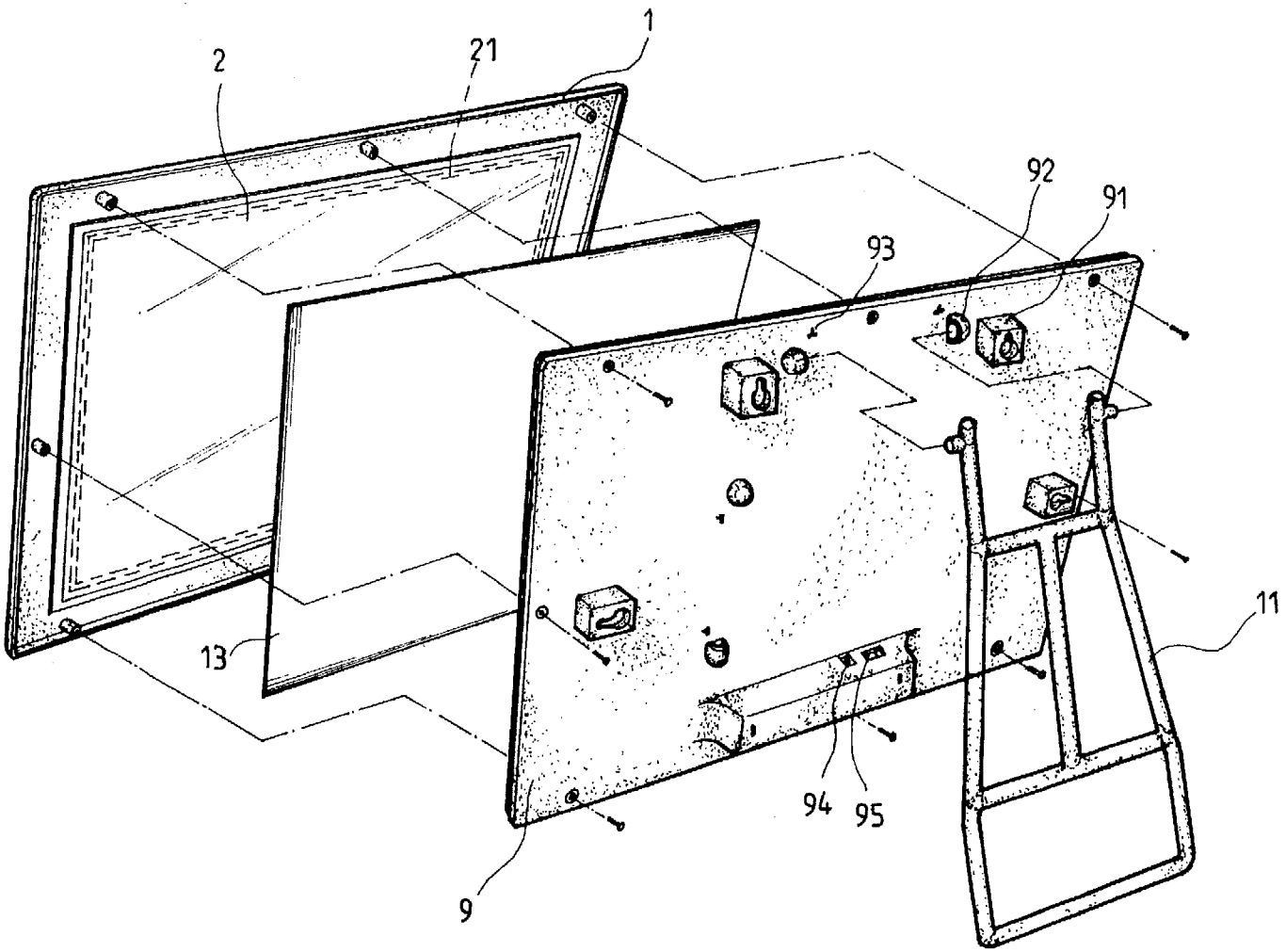
FIG. 7 is another schematic diagram of changing the slide of the neon light box of the present invention.

If changing the slide 13 is rarely required (as shown in FIG. 7), the user can first remove the top cover I from the bottom cover 9, and then place the required slide 13 at the center of the diffuser 3. The box is then reassembled, and is ready for display.

In general, the neon light box in accordance with the present invention has several advantages:

1. Using cold cathode fluorescent light (C.C.F.L.) as the light source reduces electricity consumption.
2. Using a light guide having continuous stripes thereon enables the light to emit evenly.
3. Space savings and a variety of display patterns.
4. It is easy to operate and is reusable.
5. The neon light box of the present invention can also be used as an examination tool for negative film, x-ray film, etc.

Although preferred embodiments have been described to illustrate the present invention, it is apparent that changes and modifications in the specifically described embodiments can be carried out without departing from the scope of the invention, which is intended to be limited only by the appended claims.

What I claim is:

1. A neon light box comprising:

a top cover with an opening therein, a window located under said top cover, a diffuser located under said window, a light guide used in conjunction with said diffuser to provide even light emission, a plurality of cold cathode fluorescent lights, said lights include rubber caps at each thereof, said caps function as shock absorbers and insulators, an aluminum film disposed at each end of said cold cathode fluorescent lights to concentrate and reflect light from said cold cathode fluorescent lights to said light guide, a reflection sheet located under said light guide to reflect light from said light guide, a power converter for converting input AC current into DC current required by said cold cathode fluorescent lights, a bottom cover disposed under said reflection sheet having a recess for receiving therein said power converter and a support that is adjustably attached to an outer side of said bottom cover, and a plurality of securing boards to secure said diffuser, said light guide, said cold cathode fluorescent lights, and said rubber caps, said aluminum films, and said reflection sheet within said bottom cover.

2. The neon light box as claimed in claim 1, wherein, a plurality of hanging means, a plurality of support anchors, a plurality of protrusions are formed on a rear side of said bottom cover to provide multiple means of supporting said neon light box in desired display positions.

3. The neon light box as claimed in claim 1, wherein;

said light guide has continuous grooves thereon.

4. The neon light box as claimed in claim 1, wherein;

said neon light box further comprises a transparent cover attached to said window.

5. The neon light box as claimed in claim 4 wherein;

a slide is disposed in a space between said transparent cover and said window, and said slide, by means of magnetic material affixed thereto, is secured to ferro-metallic bars on an upper surface of said window.

6. The neon light box as claimed in claim 1, wherein;

ferro-metallic bars are provided on an upper surface of said window in positions corresponding to an inner perimeter of said opening of said top cover, said bars being used to attract magnets on a transparent cover.

* * * * *